United States Patent [19]

Koya

[11] Patent Number: 4,850,420

[45] Date of Patent: Jul. 25, 1989

[54] CASTING APPARATUS

[75] Inventor: Hirokuni Koya, Zama, Japan

[73] Assignee: Toshiba Kikai Kabushiki Kaisha, Tokyo, Japan

[21] Appl. No.: 186,900

[22] Filed: Apr. 26, 1988

Related U.S. Application Data

[63] Continuation of Ser. No. 928,013, Nov. 7, 1986, abandoned.

[30] Foreign Application Priority Data

Nov. 8, 1985 [JP] Japan ..... 60-250292

[51] Int. Cl.[4] ..... B22D 17/32

[52] U.S. Cl. ..... 164/150; 164/155; 164/156; 164/316

[58] Field of Search ..... 164/150, 154, 155, 156, 164/303, 312–318, 457, 500

[56] References Cited

U.S. PATENT DOCUMENTS

| | | | |
|---|---|---|---|
| 2,195,360 | 3/1940 | Daesen | 164/314 |
| 2,224,982 | 12/1940 | Morin | 164/500 |
| 4,146,081 | 3/1979 | Reis | 164/155 |
| 4,635,706 | 1/1987 | Behrens | 164/500 |

FOREIGN PATENT DOCUMENTS

| | | | |
|---|---|---|---|
| 4423330 | 9/1959 | Japan . | |
| 219123 | 12/1968 | U.S.S.R. | 164/155 |
| 442010 | 10/1974 | U.S.S.R. | 164/156 |
| 569383 | 8/1977 | U.S.S.R. | 164/155 |

*Primary Examiner*—Richard K. Seidel

*Attorney, Agent, or Firm*—Birch, Stewart, Kolasch & Birch

[57] ABSTRACT

A cold-chamber casting apparatus formed molten metal from a crucible surface into a die cavity defined between movable and fixed die assemblies for thereby producing a die casting. The casting apparatus includes an injection sleeve having a length corresponding to the casting volume of the die cavity, a sensor for detecting when a sufficient amount of molten metal is charged into the injection sleeve, and a feed pipe interconnecting a feed slot of the injection sleeve and the crucible furnace through a pipe hole defined in the fixed die assembly. The molten metal is fed from the crucible furnace through the feed pipe into the feed slot by means of a molten-metal feeder such as an electromagnetic ppump disposed on the feed pipe.

6 Claims, 4 Drawing Sheets

PRIOR ART

CASTING APPARATUS

This application is a continuation of application Ser. No. 928,013 filed on Nov. 928,013 filed on Nov. 7, 1986 now abandoned.

BACKGROUND OF THE INVENTION

The present invention relates to a casting apparatus, and more particularly to a casting apparatus for cold-chamber die-casting machines which is capable of feeding molten metal safely into an injection sleeve or chamber and of producing high-quality castings, and which is small in size.

Casting apparatus have widely been used for obtaining a large quantity of desired cast products by pouring molten metal into a die cavity of given shape and allowing the poured molten metal to be solidified in the die cavity. Casting apparatus can roughly be classified as hot-chamber and cold-chamber casting apparatus.

One conventional cold-chamber die-casting machine is illustrated in FIG. 1 of the accompanying drawings. The illustrated cold-chamber die-casting machine includes a firmly fixed frame 2 on a floor, on which a fixed die plate 4 is securely mounted, with a fixed die 6 being secured to the fixed die plate 4. A movable die plate 8 is mounted on the frame 2 in confronting relation to the fixed die plate 4. The movable die plate 8 can be moved by a die clamping mechanism through a link mechanism (not shown). A movable die 10 is mounted on the movable die plate 8. The fixed die plate 4 and a link housing (not shown) constituting the die clamping mechanism are mounted on four tie bars 11 (only two shown in FIG. 1) and fastened thereto by tie bar nuts 12.

The movable die plate 8 is guided by the tie bars 11 while moving horizontally on the frame 2 toward and away from the fixed die plate 4. A recess 14 is defined centrally in an outer side surface of the fixed die plate. An injection sleeve or chamber 16 extends horizontally through the fixed die plate 4 and the fixed die 6 at a lower portion of the recess 14. The injection sleeve 16 has an inner open end lying flush with the inner side surface of the fixed die 6. A substantially half length of the injection sleeve 16 extends out of the fixed die plate 4. The portion of the injection sleeve 16 which extends out of the fixed die plate 4 has a relatively large pouring slot 17 defined in an upper wall thereof.

A runner 20 for supplying molten metal into a die cavity 18 defined by and between the fixed die 6 and the movable die 10 is defined in the injection sleeve 16 within the fixed die 6 and has a length hl from the interface or boundary between the movable die 10 and the fixed die 6 as they are held together. A frame 19 is affixed to the fixed die plate 4 and supports an injection cylinder 22 in confronting relation to the injection sleeve 16. The injection cylinder 22 houses a piston 24 disposed slidably therein. The piston 24 is coupled to one end of a piston rod 25, the other end thereof being connected through a coupling 26 to a rod 28. The rod 28 is coupled at its distal end to an injection plunger tip 30 that is slidably disposed in the injection sleeve 16. A crucible furnace 34 for containing molten metal 32 and keeping the same at a prescribed temperature is disposed adjacent to the die-casting machine. The molten metal 32 contained in the crucible furnace 34 is scooped by a ladle 36 and poured from the ladle 36 through the pouring slot 17 into the injection sleeve 16. Thereafter, the injection cylinder 22 is actuated to cause the injection plunger tip 30 to force the poured molten metal from the injection sleeve 16 through the runner 20 into the die cavity 18.

The conventional die-casting machine shown in FIG. 1 has proved disadvantageous for the following reasons: The relatively large pouring slot 17 is dangerous in that the operator's hand may inadvertently enter the pouring slot 17 and that the poured molten metal may be spouted from or overflow the pouring slot 17, or be scattered around from the pouring slot 17. When the molten metal is to be poured into the injection sleeve 16, the molten metal 32 is first scooped from the crucible furnace 34 by the ladle 36 and then supplied from the ladle 36 through the pouring slot 17 into the injection sleeve 16. Therefore, the molten metal 32 remains exposed to air and gets oxidized while it is being transported from the crucible furnace 34 to the injection sleeve 16, with the result that the injection sleeve 16 cannot be supplied with pure molten metal. At the time the molten metal is injected from the injection sleeve 16 into the die cavity 18, the surface of the molten metal 32 within the injection sleeve 16 must be lower than the pouring slot 17. In practice, the charging efficiency of the injection sleeve 16 for the molten metal is 40 through 50% or less in terms of the ratio of the volume of the poured molten metal to the volume of the injection sleeve 16.

The charging efficiency of the conventional die-casting machine has been increased by increasing the length to the stroke (hereinafter referred to as an "injection stroke") which the injection plunger tip 30 has to move in the injection sleeve 16. The injection stroke thus increased has been 2 to 2.5 times larger than an injection stroke which is originally required, resulting in a large-size and costly hydraulic device needed to operate the injection plunger tip 30.

The recess 14 must be provided for the ladle 36 to be operated without physical interference with the fixed die plate 4. The recess 14 however reduces the mechanical strength of the fixed die plate 4.

The molten metal in the injection sleeve 16 is injected by the injection plunger tip 30 when the charging efficiency of the injection sleeve 16 for the molten metal therein is in the range of from 40 to 50%. Upon injection of the molten metal, the molten metal near the plunger tip 30 is caused thereby to swirl up, trapping air as indicated at A in FIG. 2. This results in blowholes or cavities in the produced die casting.

Where the die cavity defined by the fixed and movable dies is small and so is the volume of a resulting die casting, the injection sleeve 16 may be short since the amount of molten metal 32 to be transported by the ladle 36 needs to be small. However, inasmuch as the fixed die plate 4 is significantly thick even with the recess 14 defined therein and the pouring slot 17 is positionally limited in order to achieve easy maneuvering of the ladle 36, the injection sleeve 16 is inevitably longer than necessary. Before the molten metal 32 is introduced into the die cavity 18, an amount of molten metal 32 which is greater than required to fill up the relatively small die cavity 18 must be charged into the relatively long injection sleeve 16. It has been customary to reduce the excess molten metal that remains in the injection sleeve 16 after the die cavity 18 has been filled, by increasing the length of the runner 20 of the movable die 10 up to h2 as shown in FIG. 3, thereby to shorten the effective length of the injection sleeve 16.

Increasing the length of the runner 20 has however resulted in a low yield for die castings and an increased cost of manufacture.

The present invention has been made in an effort to overcome the aforesaid problems of the conventional casting apparatus.

SUMMARY OF THE INVENTION

It is an object of the present invention to provide a casting apparatus which includes a crucible furnace for storing molten metal at a constant temperature, an injection sleeve directly coupled to the crucible furnace by a feed pipe, a feed mechanism such as an electromagnetic pump, rather than a ladle, disposed on the feed pipe for feeding molten metal from the crucible furnace into the injection sleeve, and a sensor disposed in the injection sleeve for detecting when a prescribed amount of molten metal is charged in the injection sleeve, to allow an injection plunger tip to be displaced in the injection sleeve for thereby forcing the molten metal into a die cavity.

According to the present invention, there is provided a cold-chamber casting apparatus comprising a crucible surface for containing molten metal, movable and fixed die assemblies jointly defining a die cavity having a casting volume for producing a die casting by forcing molten metal from the crucible furnace thereinto, an injection sleeve having a length corresponding to the casting volume of the die cavity and including a feed slot, a sensor for detecting when a sufficient amount of molten metal is charged into the injection sleeve, a feed pipe interconnecting the feed slot of the injection sleeve and the crucible furnace through a pipe hole defined in the fixed die assembly, and feeder means for feeding the molten metal from the crucible furnace through the feed pipe into the feed slot.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
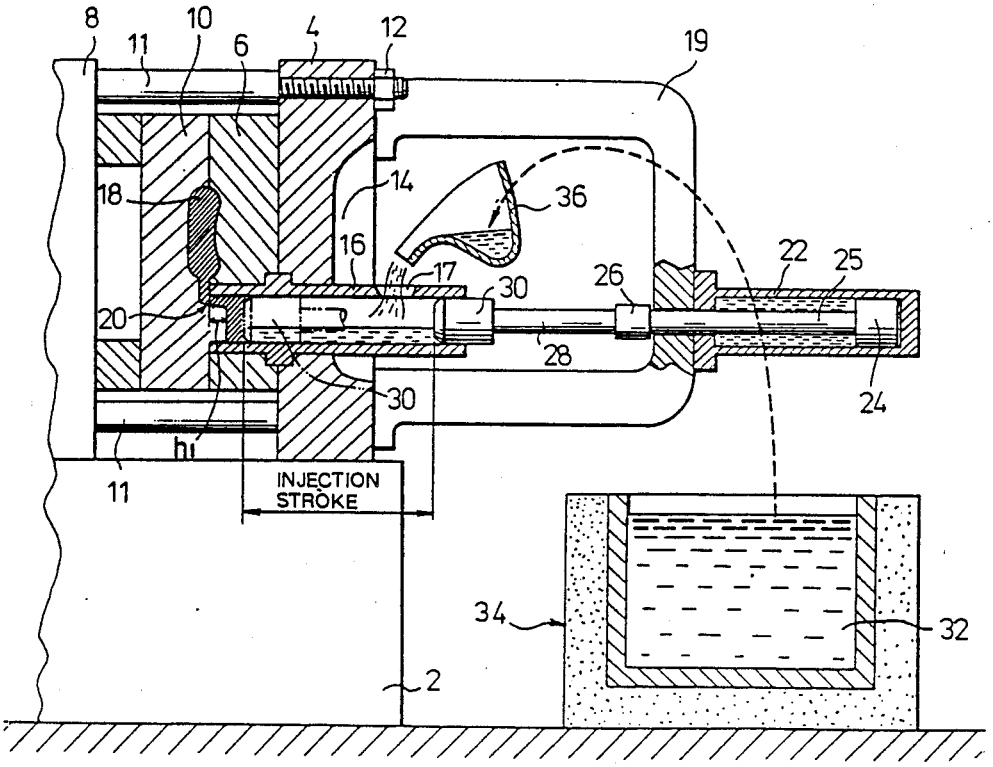
FIG.1 PRIOR ART
FIG. 1 is a partly cross-sectional view of a conventional casting apparatus.
Figure 2:
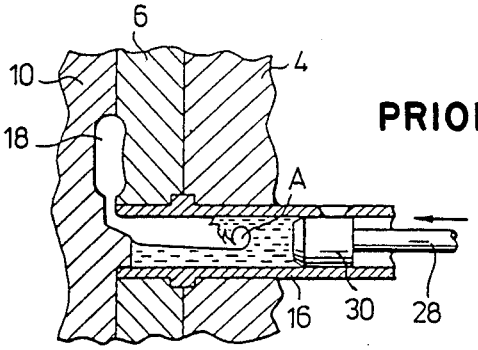
FIG. 2 is a fragmentary cross-sectional view showing the manner in which air is trapped in molten metal in the casting apparatus shown in FIG. 1.
Figure 3:
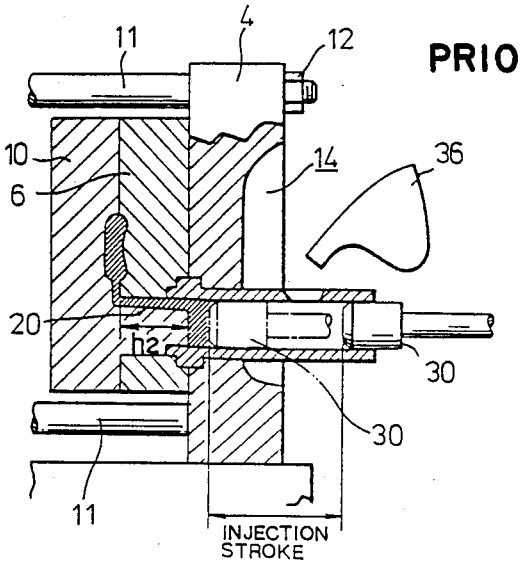
PRIOR ART FIG.3
FIG. 3 is a partly cross-sectional view showing a runner of an increased length in a conventional casting apparatus.
Figure 4:
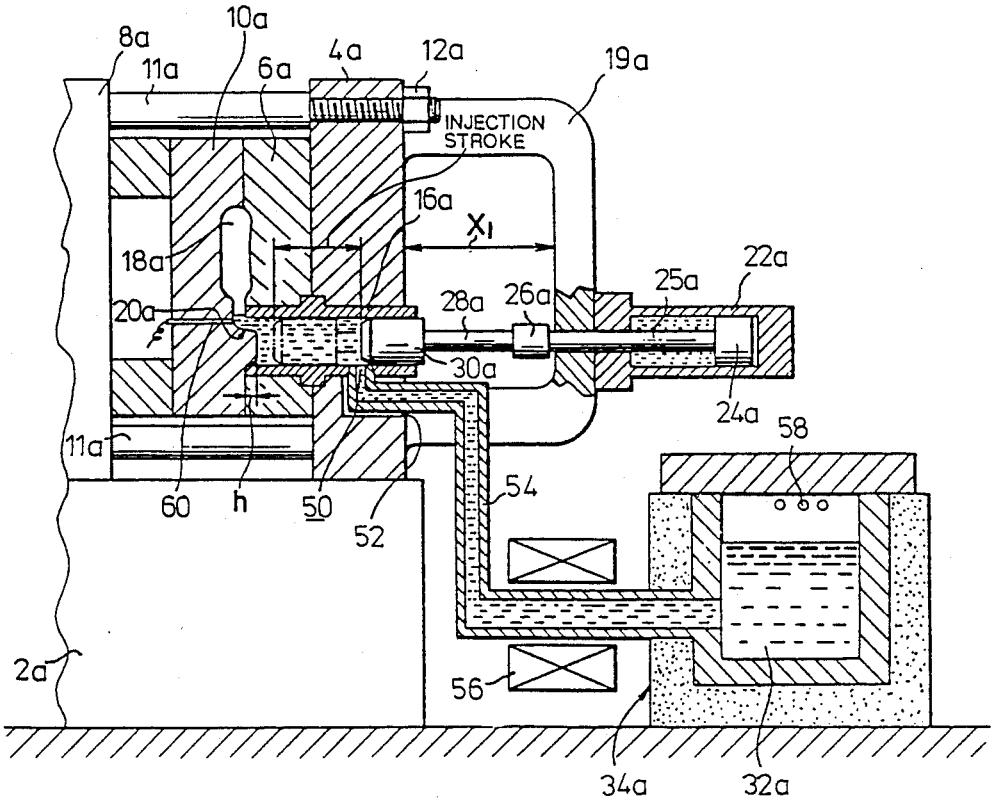
FIG. 4 is a partly cross-sectional view of a casting apparatus according to an embodiment of the present invention.

FIG. 4 shows a cold-chamber casting apparatus according to an embodiment of the present invention. Those parts shown in FIG. 4 which are identical to those shown in FIGS. 1 through 3 are denoted by identical reference characters with a suffix a, and will not be described in detail.

An injection sleeve **16*a* having a length which is about half that of the conventional injection sleeve 16 (FIG. 1) is disposed in a fixed die plate 4*a* slightly below its center. The injection sleeve 16*a* has a feed slot 50 defined centrally in a lower wall of its portion inserted in the fixed die plate 4*a*. The fixed die plate 4*a* has an L-shaped pipe hole 52 defined therein beneath the feed slot 50 in communication therewith. A feed pipe 54 for feeding molten metal into the injection slot 16*a* has one end extending in the pipe hole 52 and coupled to the feed slot 50**.

The other end of the feed pipe 54 is joined to a lower portion of a crucible furnace **34*a* which stores molten metal 32*a* and keeps the same at a prescribed temperature. An electromagnetic pump 56 is disposed on the feed pipe 54 for feeding the molten metal 32*a* from the crucible furnace 34*a* into the injection sleeve 16*a* through the feed slot 50. The crucible furnace 34*a* has a heater 58 which, when energized, keeps the molten metal 32*a* in the crucible furnace 34*a*** at the prescribed temperature.

A die cavity **18*a* is defined by and between a fixed die 6*a* and a movable die 10*a*. A sensor 60, such as a temperature sensor, is disposed at the lower end of the die cavity 18*a* which communicates with the injection sleeve 16*a* through a runner 20*a*. When a sufficient amount of molten metal is charged in the injection sleeve 16*a*, the sensor 60 contacts the charged molten metal and detects that molten metal is enough i.e. 100% supplied in the injection sleeve 16*a*. The sensor 60** is not limited to a temperature sensor, but may be a current sensor capable of detecting an electric current which is passed through the molten metal that is electrically conductive.

A frame **19*a* is connected to an outer side surface of the fixed die plate 4*a*. Since the injection sleeve 16*a* is much shorter than the conventional injection sleeve 16, the width Xl of the frame 19*a* is also smaller than that of the conventional frame. Therefore, a rod 28*a* connected to a coupling 26*a* and holding an injection plunger tip 30*a*** is also considerably shorter than the conventional rod.

Operation of the casting apparatus shown in FIG. 4 will be described below.

The molten metal **32*a* stored in the crucible furnace 34*a* is heated up to and kept at a desired temperature by energizing the heater 58. At this time, the injection plunger tip 30*a* is retracted to the illustrated position by an injection cylinder 22*a*. The electromagnetic pump 56 is now energized to feed the molten metal 32*a* from the crucible furnace 34*a* through the feed pipe 54 into the injection sleeve 16*a*. The electromagnetic pump 56 is continuously energized to charge the molten metal 32*a* into the injection sleeve 16*a* until a desired amount of the molten metal 32*a* is contained in the injection sleeve 16*a*, whereupon it is detected by the temperature sensor 60. The temperature sensor 60 now generates a signal which is sent to a control circuit (not shown) that applies a deenergization signal to the electromagnetic pump 56. Therefore, the signal from the temperature sensor 60 deenergizes the operation of the electromagnetic pump 56 to stop feeding the molten metal 32*a* into the injection sleeve 16*a***.

Then, the control circuit applies a signal to operate a hydraulic device (not shown) for driving the injection cylinder **22*a*. The piston rod 25*a* of the injection cylinder 22*a* is advanced at a prescribed speed to cause the injection plunger tip 30*a* to move forwardly in the injection sleeve 16a at the same speed. The molten metal 32a charged in the injection sleeve 16a is forced by the plunger tip 30a through the runner 20a into the die cavity 18a**.

When the injection plunger tip 30a has been advanced a predetermined stroke by the injection cylinder 22a, the piston rod 25a is prevented from further advancing movement and the injection cylinder 22a is inactivated. Upon elapse of a certain period of time, the molten metal 32a in the die cavity 18a is cooled and solidified. After the molten metal 32a in the die cavity 18a has been solified, the injection cylinder 22a is actuated to retract the plunger tip 30 away from the die cavity 18a.

Since the molten metal 32a is supplied from the crucible furnace 34a through the feed pipe 54 directly into the injection sleeve 16a without being exposed to air, there is no danger of the operator's hand to entering the injection sleeve 16a inadvertently or for the molten metal to overflow or be spouted or scattered from the injection sleeve 16a. Inasmuch as the molten metal 32a is not oxidized during tranfer from the crucible furnace 34a to the injection sleeve 16a, desired pure molten metal can be supplied into the die cavity 18a. The injection stroke is short and no blowholes or cavities are formed in a die casting produced because the injection cylinder 22a is actuated after enough molten metal has been charged in the injection sleeve 16a. In the absence of any ladle for feeding the molten metal 32a from the crucible furnace 34a to the injection sleeve 16a, it is not necessary to provide a recess in the fixed die plate 4a for the maneuvering of such a ladle, and the mechanical strength of the fixed die plate 4a is not reduced. As the injection sleeve 16a is short, the injection plunger can be shortened even if the casting volume of the die cavity 18a is small.

Figure 5:
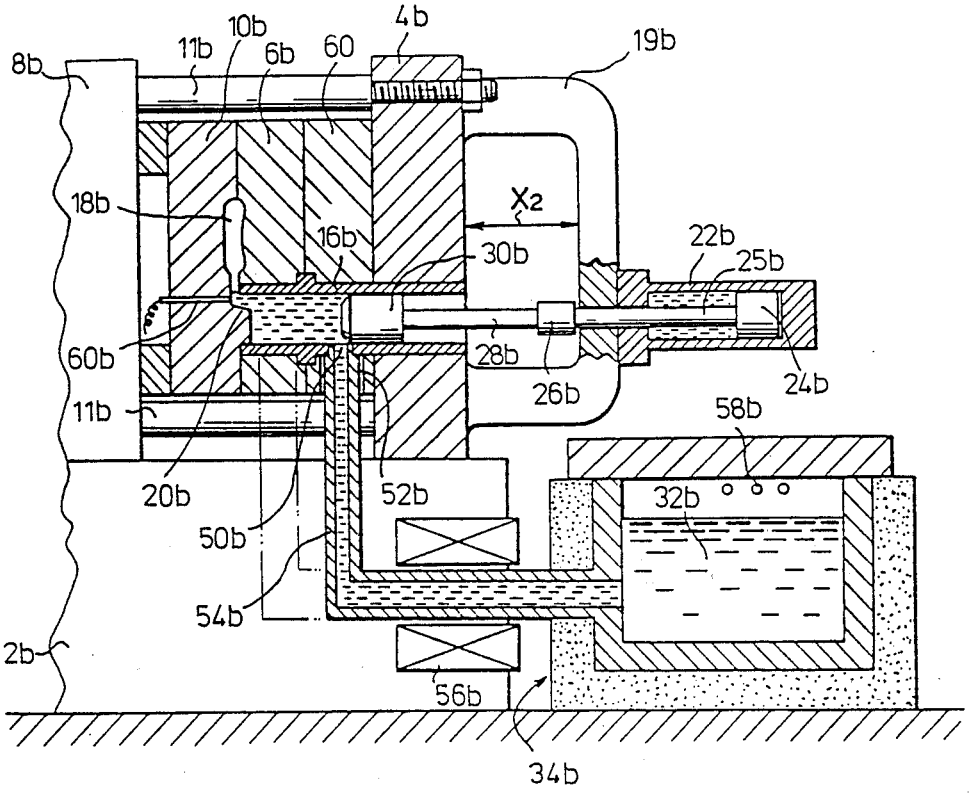
FIG. 5 is a partly cross-sectional view of a casting apparatus according to another embodiment of the present invention.

FIG. 5 shows a casting apparatus according to another embodiment of the present invention. Those parts shown in FIG. 5 which are identical to those of the preceding embodiment are denoted by identical reference characters with a suffix b, and will not be described in detail.

The casting apparatus of FIG. 5 includes a die cavity 18b having a smaller casting volume than that of the die cavity 18a of FIG. 4. A fixed-die attachment block 60 is secured to a fixed die plate 4b, and a fixed die 6b is attached to the fixed-die attachment block 60.

An injection sleeve 16b is fixedly mounted in and extends through the fixed-die attachment block 60 and the fixd die 6b. An injection plunger tip 30b is inserted in the injection sleeve 16b through a through hole defined in the fixed die plate 4b. The injection sleeve 16b has a feed slot 50b defined centrally in a lower wall of its portion which is fitted in the fixed-die attachment block 60. The fixed-die attachment block 60 has a pipe hole 52b defined therein beneath the feed slot 50b in communication therewith. A feed pipe 54b has an upper open end inserted in the pipe hole 52b and coupled to the feed slot 50b. The other structural details are the same as those of the embodiment shown in FIG. 4.

The quantity of molten metal 32a charged sufficiently in the injection sleeve 16b is small since the casting volume of the die cavity 18b is small. The injection stroke is short because the injection sleeve 16b is short. The width X2 of a frame 19b is shorter than that of the frame 19a of FIG. 4.

In the case where the die cavity 18b may be smaller, a pipe hole may be defined in the fixed die 6b and the upper open end of the feed pipe 54 may be coupled through the pipe hole to the feed slot defined in the injection sleeve 16b, as indicated by the broken lines in FIG. 5.

The electromagnetic pump is employed as a molten-metal feeder in each of the embodiments of FIGS. 4 and 5. However, the crucible furnace may be of an airtight sealed structure, and a molten-metal feeder for feeding molten metal under air pressure from the crucible furnace may be employed. Alternatively, the injection sleeve and the die cavity may be evacuated, and a vacuum molten-metal feeder for feeding molten metal under vacuum into the injection sleeve may be employed.

With the arrangement of the present invention, as described above, the molten metal is fed from the crucible furnace under a sealed condition, i.e., without exposure to air, into the injection sleeve. Therefore, the casting operation can be performed safely, and the molten metal is prevented from being oxidized. The die cavity can thus be supplied with desired pure molten metal. In addition, die castings free from blowholes or cavities can be produced since no air is trapped in the molten metal in the injection sleeve.

Because the injection sleeve is short, the cost of the casting apparatus can be reduced. The feed slot for supplying the molten metal into the injection sleeve can be defined in any one of the fixed die, the fixed-die attachment block, or and the fixed die plate, dependent on the casting volume of the die cavity. The height of the runner can be minimized for a higher yield for die castings.

Although certain preferred embodiments have been shown and described, it should be understood that many changes and modifications may be made therein without departing from the scope of the appended claims.

What is claimed is:

1. A cold-chamber casting apparatus comprising: a crucible furnace for containing molten metal; movable and fixed die assemblies jointly defining a die cavity having a casting volume for producing a die casting by forcing molten metal from said crucible furnace thereinto; an injection sleeve having a length corresponding to the casting volume of said die cavity and including a feed slot located at a bottom portion of said injection sleeve; a sensor provided to face an outlet portion of said injection sleeve, said sensor being located in a lower end of said die cavity in said movable die assembly for detecting when a sufficient amount of molten metal is charged into said injection sleeve; a feed pipe interconnecting the feed slot of said injection sleeve and said crucible furnace through a pipe hole defined in said fixed die assembly; an electro-magnetic pump means provided with regard to said feed pipe for feeding the molten metal from said crucible furnace through said feed pipe into said feed slot wherein said electro-magnetic pump means is controlled by way of receiving an output signal from said sensor; and said sensor location enabling a detection of a completely filled injection sleeve, thereby preventing air from becoming entrapped in the molten metal.

2. A cold-chamber casting apparatus according to claim 1, wherein said fixed die assembly includes a fixed die plate, said pipe hole being defined in said fixed die plate, said feed pipe being connected to said injection sleeve through said pipe hole in said fixed die plate.

3. A cold-chamber casting apparatus according to claim 1, wherein said fixed die assembly includes a fixed-die attachment block, said pipe hole being defined in said fixed-die attachment block, said feed pipe being connected to said injection sleeve through said pipe hole in said fixed-die attachment block.

4. A cold-chamber casting apparatus according to claim 1, wherein said fixed die assembly includes a fixed die, said pipe hole being defined in said fixed die, said feed pipe being connected to said injection sleeve through said pipe hole in said fixed die.

5. A cold-chamber casting apparatus according to claim 1, wherein said sensor comprises a temperature sensor.

6. A cold-chamber casting apparatus according to claim 1, wherein said sensor comprises a current sensor.

* * * * *

UNITED STATES PATENT AND TRADEMARK OFFICE

CERTIFICATE OF CORRECTION

PATENT NO. : 4,850,420

DATED : July 25, 1989

INVENTOR(S) : Hirokuni KOYA

It is certified that error appears in the above—identified patent and that said Letters Patent is hereby corrected as shown below:

On the title page, under the category "[21] Appl. NO." change "186,900" to --186,390--.

Signed and Sealed this

Twenty-ninth Day of May, 1990

*Attest:*

HARRY F. MANBECK, JR.

*Attesting Officer*

*Commissioner of Patents and Trademarks*